US010167678B2

(12) United States Patent
Luo et al.

(10) Patent No.: US 10,167,678 B2
(45) Date of Patent: Jan. 1, 2019

(54) PULL TUBE STRESS JOINT FOR OFFSHORE PLATFORM

(71) Applicants: TECHNIP FRANCE, Courbevoie (FR); Michael Y. H. Luo, Bellaire, TX (US); Thomas Wozniak, Houston, TX (US); Timothy Otis Weaver, Houston, TX (US)

(72) Inventors: Michael Y. H. Luo, Bellaire, TX (US); Thomas Wozniak, Houston, TX (US); Timothy Otis Weaver, Houston, TX (US)

(73) Assignee: TECHNIP FRANCE, Courbevoie (FR)

( * ) Notice: Subject to any disclaimer, the term of this patent is extended or adjusted under 35 U.S.C. 154(b) by 0 days.

(21) Appl. No.: 14/888,393

(22) PCT Filed: Apr. 25, 2014

(86) PCT No.: PCT/US2014/035541
§ 371 (c)(1),
(2) Date: Oct. 30, 2015

(87) PCT Pub. No.: WO2014/179176
PCT Pub. Date: Nov. 6, 2014

(65) Prior Publication Data

US 2016/0076313 A1 Mar. 17, 2016

Related U.S. Application Data

(63) Continuation of application No. 13/874,997, filed on May 1, 2013, now abandoned.

(51) Int. Cl.
*E21B 17/01* (2006.01)
*E21B 19/00* (2006.01)

(52) U.S. Cl.
CPC ..... *E21B 17/015* (2013.01); *E21B 17/017* (2013.01); *E21B 19/004* (2013.01)

(58) Field of Classification Search
CPC ..... E21B 17/015; E21B 17/017; E21B 19/004
(Continued)

(56) References Cited

U.S. PATENT DOCUMENTS 4,516,881 A 5/1985 Beynet et al.
4,741,647 A 5/1988 Dumazy et al.
(Continued)

FOREIGN PATENT DOCUMENTS

EP 0898047 2/1999
GB 2356229 5/2001

OTHER PUBLICATIONS

Manolache, I., International Search Report for International Patent Application No. PCT/US2010/046296, European Patent Office, dated Apr. 14, 2011.

(Continued)

*Primary Examiner* — Matthew R Buck
*Assistant Examiner* — Patrick F Lambe
(74) *Attorney, Agent, or Firm* — Jackson Walker, LLP

(57) ABSTRACT

The present disclosure provides a system and method for supporting a catenary riser coupled to an offshore platform system including a pull tube and a pull tube stress joint for girth weld stress reduction and improved fatigue performance. A pull tube sleeve is coupled around a welded connection of the pull tube. The sleeve has a larger inner diameter than an outer diameter of the pull tube to form an annular space therebetween, and a fill material is filled into the space between the sleeve and the pull tube. The fill material provides a supportive coupling between the sleeve and the pull tube. The sleeve, the pull tube, or both can have gripping surfaces formed in or on their surfaces to retain the
(Continued)

fill material in the space. The sleeve can be formed from a plurality of portions and be welded, fastened, or otherwise coupled around the pull tube.

20 Claims, 13 Drawing Sheets

(58) Field of Classification Search
USPC ..... 166/367
See application file for complete search history.

(56) References Cited

U.S. PATENT DOCUMENTS 5,028,171 A * 7/1991 Gray ..... E02B 17/0008 405/225
5,873,677 A * 2/1999 Davies ..... E21B 17/017 285/216
6,739,804 B1 5/2004 Haun
2001/0045239 A1* 11/2001 Villatte ..... F16L 13/0272 138/172
2003/0021634 A1 1/2003 Munk et al.
2007/0056741 A1 3/2007 Finn et al.
2010/0139802 A1* 6/2010 Papon ..... F16L 13/0218 138/141
2011/0048729 A1* 3/2011 Luo ..... E21B 19/004 166/367
2013/0115009 A1* 5/2013 Mebarkia ..... E21B 43/01 405/171

OTHER PUBLICATIONS

Manolache, I., Written Opinion for International Patent Application No. PCT/US2010/046296, European Patent Office, dated Apr. 14, 2011.

* cited by examiner

PULL TUBE STRESS JOINT FOR OFFSHORE PLATFORM

CROSS REFERENCE TO RELATED APPLICATIONS

This application is a 371 application of PCT Application No. PCT/US14/35541 dated Apr. 25, 2014 which is an international application of U.S. Non-Provisional Ser. No. 13/874,997, filed May 1, 2013.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

Field of the Invention

The disclosure generally relates to the production of hydrocarbons from subsea formations. More particularly, the disclosure relates to the risers and related support structures used in such production.

Description of the Related Art

In producing hydrocarbons from subsea formations, a number of wells are typically drilled into the sea floor in positions that are not directly below or substantially within the outline of an offshore floating platform, such as a floating offshore production platform. The produced hydrocarbons are subsequently exported via subsea pipelines or other means. Current engineering practice links the offset wells with the offshore platform through risers that have a catenary curve between the platform and the sea floor. Wave motion, water currents, and wind cause movement of the floating offshore structure and/or risers themselves with corresponding flex and stress in the risers. The current state of the art has accommodated the flex in the risers by incorporating flexible joints at suitable locations between pipe segments in the riser. However, the flexible joints are more expensive and less reliable than pipe segments that are welded together.

Steel Catenary Risers (SCRs) are designed to be coupled to the floating offshore structure through pull tubes extending from the lower keel of the offshore structure to the upper part of the offshore structure. A pull tube is generally a long conduit that forms a guide through which the SCR is pulled from the seafloor and coupled to the offshore structure. The pull tube is attached to the offshore structure at an angle from the vertical so as to be in line with a natural catenary angle that the installed SCR would assume on a calm day. As the offshore structure shifts laterally and vertically, the pull tube helps reduce stresses on the SCR. However, the pull tube itself is then stressed and can fail with time. The pull tube is attached to the offshore structure at one or more attachment points and thus flexes about its attachment points to the offshore structure as the SCR flexes and bends from the movement of the floating offshore structure. A first attachment point can be located a distance from the lower end of the pull tube. A second attachment point for the pull tube to the offshore structure can be at a distance further upward from the first attachment point to allow additional flexibility in the pull tube. Further, the pull tube can be provided with a bending stiffness that varies from the first attachment point to the lower end of the pull tube.

Typically, a tapered stress joint is placed along the pull tube adjacent one of the attachment points and is sized to control the SCR stress. The main function of a pull tube stress joint is to provide flexible support for the riser and the pull tube around the riser. To achieve the flexibility requires a small section modulus and a relatively very long length. These stress joints can cost in the current dollars $1,000,000 to $1,500,000 each for a typical pull tube, but are very important to the pull tube life. With an exemplary number of 12 pull tubes in an offshore platform needing 12 sleeve joints, the costs can approach in current dollars $15,000,000 to $20,000,000.

There are two types of stress joints that have been used in the past. The first one is an assembly of pipe segments welded together. The pipe segments typically have a progressively smaller wall thickness for each segment of a given inner diameter that results in a tapered assembly of the segments with the thinnest segment distal from the middle of the welded assembly to allow more flexibility at the end of the assembly for the SCR. Such assemblies typically are challenged by fatigue performance at the welds between the segments for the many years in which the SCR will likely be used. The second type of stress joint is a forged tapered stress joint. The forging accomplishes a similar goal as the first type by progressively thinning the wall thickness toward the end of the forging typically in the length of 40 ft. However, due to the desired length of a pull tube stress joint, additional pull tube segments are typically welded to the forging. To obtain a 120 ft. or 160 ft. length, three to four girth welds are needed. Thus, the challenge is still fatigue performance at the welds between the segments and forging.

Another challenge can be cost and manufacturing schedules specific to a lengthy forging piece. The current exemplary costs for a 160 ft. stress joint is $1,500,000 with a 1½ year lead time for delivery. For larger diameter risers, the length can increase to perhaps 240 ft. with an expected substantial increase in costs.

More particularly, FIG. 1 is an exemplary prior art schematic of a pull tube stress joint. The pull tube stress joint 50 is adapted to allow a riser 53 to be pulled therethrough and includes a tapered middle section 51, which can be one of the two types described above of a progressively smaller wall thickness of an assembly of pipe segments or a continuous forging. The middle section 51 has a length "L", which can for example be about 40 feet (12 meters) and is typically centrally disposed relative to a pivot point "A", so that a ½ L length extends 20 feet (6 meters) outward therefrom in this example. A pull tube joint 52 is welded to the end of the middle section 51 at welding B about 20 feet (6 meters) from the pivot point A. The stresses at welding B are such that special and expensive welding procedures known as a "C Class Girth Weld" are typically specified to attempt to reduce fatigue at the welding B at the 20-foot (6 meter) location from the pivot point A. Only a few companies at present are qualified to perform a "C" Class Girth Weld. While a longer middle section could be used to extend the ½ L length from the pivot point A, the expense and timing of production and handling make such an option unsuitable for practical reasons.

An improvement to the pull tube stress joint of FIG. 1 is shown in US Publ. No. 2011/0048729. The shown pull tube sleeve stress joint includes at least one sleeve surrounding a length of the pull tube with an annular gap between the sleeve and pull tube and a link ring therebetween. For embodiments having a plurality of sleeves, a first sleeve can be spaced by an annular first gap from the pull tube and coupled thereto with a first ring between the pull tube and the first sleeve, and a second sleeve can be spaced by an annular second gap from the first sleeve and coupled thereto with a second ring between the first sleeve and the second sleeve.

Despite this improvement, there remains then a need to simplify the structure of a pull tube stress joint system for catenary risers and yet still provide for a suitably long lasting, cost effective pull tube stress joint. This challenge has not been suitably met in the marketplace prior to the present invention.

BRIEF SUMMARY OF THE INVENTION

The present disclosure provides an improved design for a system and method for supporting a catenary riser from an offshore platform that includes a pull tube stress joint and associated pull tube. The new design efficiently results in a pull tube stress joint sleeve coupled to a pull tube at a welded connection of the pull tube, the sleeve having a larger inner diameter than an outer diameter of the pull tube at the welded connection, and a hardenable fill material filled into an annular space between the sleeve and the pull tube. Without limitation, the fill material can be concrete, grout, or other cement-based materials; rubberized materials, including rubberized grout; polymeric materials, such as epoxies and phenolics; and other materials that can be filled into the space between the sleeve and the pull tube to provide a supportive coupling between the sleeve and the pull tube. The sleeve, the pull tube, or both can also have one or more gripping surfaces formed in or on their surfaces, such as ribs, indentions, projections, or other surface irregularities above or below the nominal surface of the sleeve and/or pull tube. The sleeves can be formed from a plurality of sleeve portions that are coupled together around the diameter of the pull tube. With the sleeves, the stress at the girth welds can be significantly reduced, and then the fatigue performance of the entire pull tube stress assembly will be significantly improved.

The disclosure provides a system for supporting a catenary riser coupled to an offshore platform, comprising: a pull tube having an outer diameter surface and an inner diameter surface, the inner diameter surface being sized to allow the riser to pass therethrough, the pull tube having a lower end disposed downward from the offshore platform and at an upper portion distal from the lower end disposed toward the offshore platform, and the pull tube further having one or more segments welded together to establish one or more welded connections with the pull tube extending longitudinally on both sides of the welded connections; a pull tube guide coupled to the offshore platform and coupled to the outer diameter surface of the pull tube between the lower end and the upper portion; a first pull tube stress joint sleeve disposed around a length of the pull tube at a first welded connection and longitudinally extending on both sides of the first welded connection, the first sleeve having an outer diameter surface and an inner diameter surface, the sleeve inner diameter surface being larger than the pull tube outer diameter surface; and a first quantity of fill material coupled between the sleeve inner diameter surface and the pull tube outer diameter surface to fill a cross section of the annular gap between the two surfaces.

The disclosure also provides a method of supporting a catenary riser coupled to an offshore platform, comprising: providing a plurality of segments of a pull tube having an outer diameter surface and an inner diameter surface, the inner diameter surface being sized to allow the riser to pass therethrough; welding at least two of the segments together to establish one or more welded connections with the pull tube extending longitudinally on both sides of the welded connection; coupling the pull tube to the offshore platform between a lower end of the pull tube disposed downward from the offshore platform and at an upper portion of the pull tube distal from the lower end disposed toward the offshore platform; coupling a first pull tube stress joint sleeve around a first welded connection of the pull tube, the first sleeve having an outer diameter surface and an inner diameter surface, the sleeve inner diameter surface being larger than the pull tube outer diameter surface; and filling a gap between the sleeve inner diameter surface and the pull tube outer diameter surface with a first quantity of a fill material.

DETAILED DESCRIPTION

Figure 1:
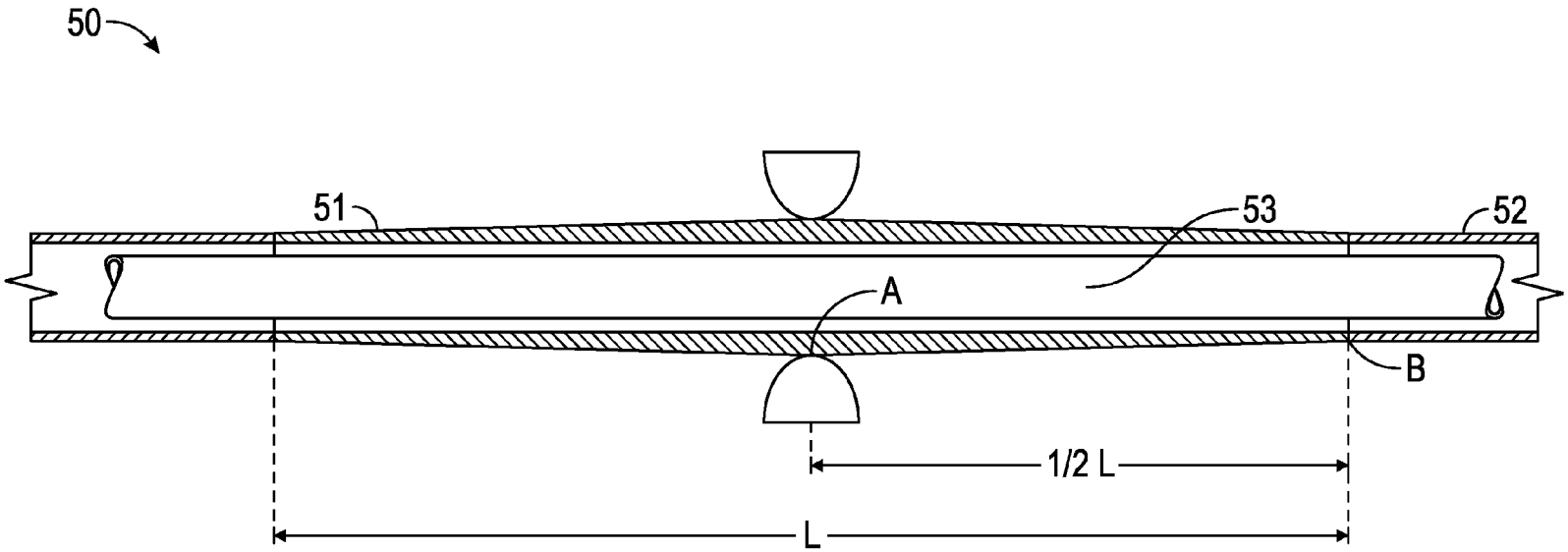
FIG. 1 (Prior Art)
FIG. 1 is an exemplary prior art schematic of a pull tube stress joint.

The Figures described above and the written description of specific structures and functions below are not presented to limit the scope of what Applicant has invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present disclosure will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of ordinary skill in this art having benefit of this disclosure. It must be understood that the inventions disclosed and taught herein are susceptible to numerous and various modifications and alternative forms. The use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims. Where appropriate, some elements have been labeled with an "A", "B", and so forth to designate various members of a given class of an element. When referring generally to such elements, the general number without the letter is used even though the general number without a letter is not designated specifically on a figure. Further, such designations do not limit the number of members that can be used for that function.

In general, the present disclosure provides an improved design for a system and method for supporting a catenary riser from an offshore platform that includes a pull tube stress joint and associated pull tube. The new design efficiently results in a pull tube stress joint sleeve coupled to a pull tube at a welded connection of the pull tube, the sleeve having a larger inner diameter than an outer diameter of the pull tube at the welded connection, and a hardenable fill material filled into an annular space between the sleeve and the pull tube. Without limitation, the fill material can be concrete, grout, or other cement-based materials; rubberized materials, including rubberized grout; polymeric materials, such as epoxies and phenolics; and other materials that can be filled into the space between the sleeve and the pull tube to provide a supportive coupling between the sleeve and the pull tube. The sleeve, the pull tube, or both can also have one or more gripping surfaces formed in or on their surfaces, such as ribs, indentions, projections, or other surface irregularities above or below the nominal surface of the sleeve and/or pull tube. The sleeves can be formed from a plurality of sleeve portions that are coupled together around the diameter of the pull tube, and in some embodiments held in position with clamps.

Figure 2:
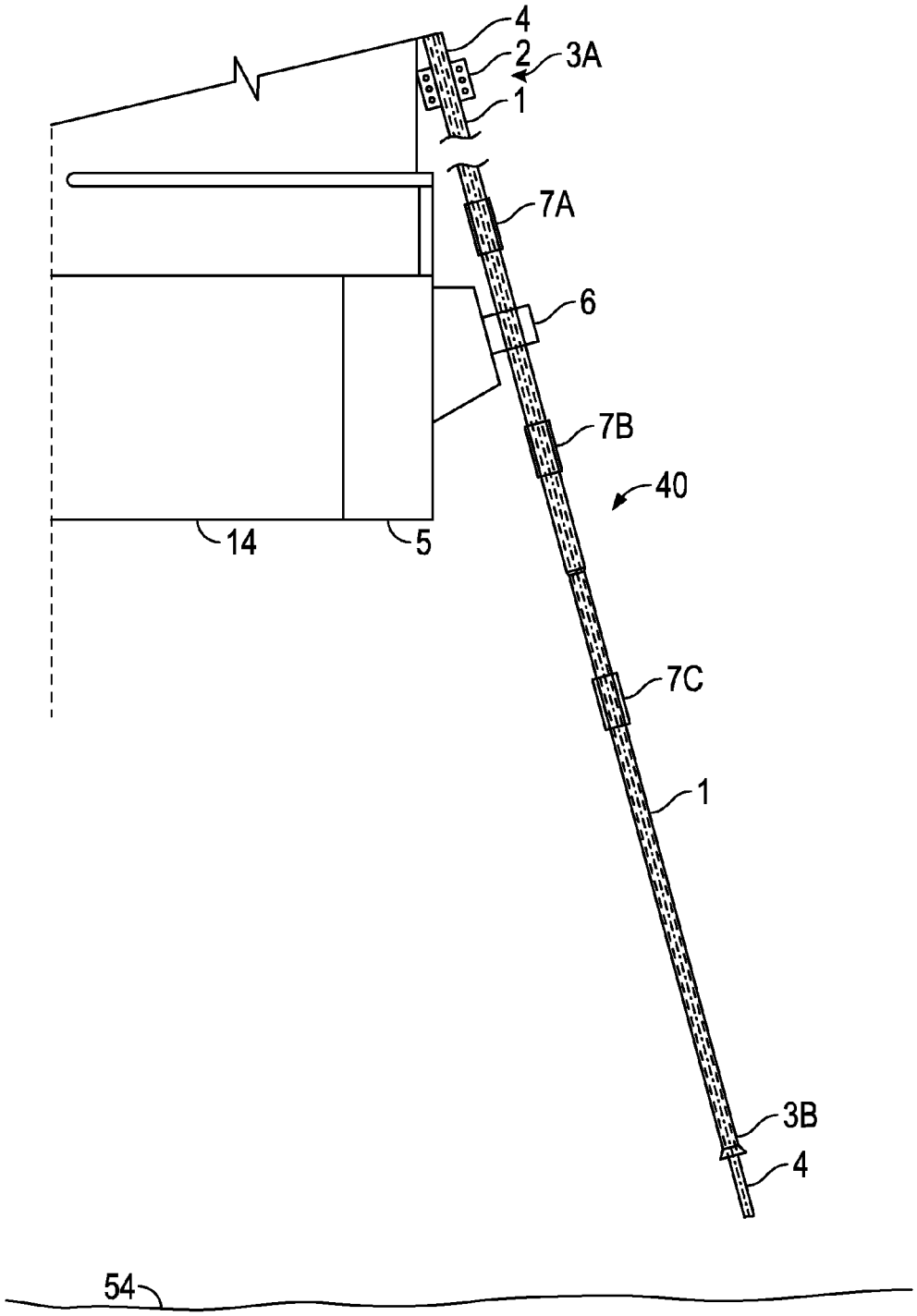
FIG. 2 is a side view schematic diagram illustrating an exemplary system for supporting a catenary riser coupled to an offshore platform with a pull tube, a pull tube guide coupled to the platform and supporting the pull tube, and a plurality of pull tube stress joint sleeves at locations along the pull tube.

FIG. 2 is a side view schematic diagram illustrating an exemplary system for supporting a catenary riser coupled to an offshore platform with a pull tube, a pull tube guide coupled to the platform and supporting the pull tube, and a plurality of pull tube stress joint sleeves at locations along the pull tube. The pull tube 1 is coupled to the offshore platform 14, such as with an upper support 2, generally at an upper portion 3A of the pull tube. A lower end 3B of the pull tube 1 is generally directed downward from the offshore platform 14 toward a seafloor 54 and the end is flared open to insert and guide a riser 4, such as a Steel Catenary Riser (SCR), from the seafloor into the pull tube 1. The pull tube 1 is maintained in proximity to the offshore platform 14, such as in proximity to a soft tank 5, by a pull tube guide 6, also referenced as a "casting guide." The pull tube guide 6 is coupled to the outer diameter surface of the pull tube 1 between the lower end 3B and the upper portion 3A. The pull tube guide 6 is coupled to the offshore platform 14 and extends laterally outward from the platform to provide a transition of angle of the catenary shape of the riser 4, as the riser approaches the offshore platform 14. One or more pull tube stress joint sleeves 7A, 7B, 7C, and 7D (and others as appropriate) surround one or more portions of the pull tube 1 generally where a welded connection is made between segments of the pull tube, as described below.

Figure 3:
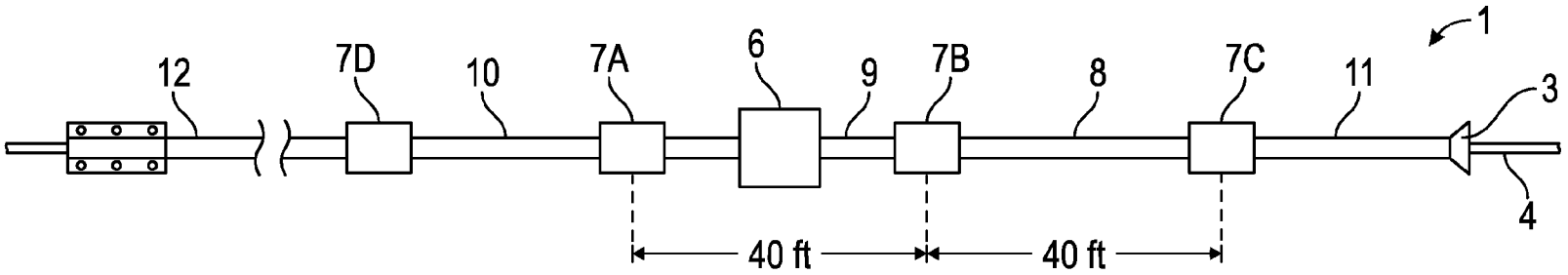
FIG. 3 is a side view schematic diagram illustrating the pull tube with the pull tube stress joint sleeves.
Figure 4:
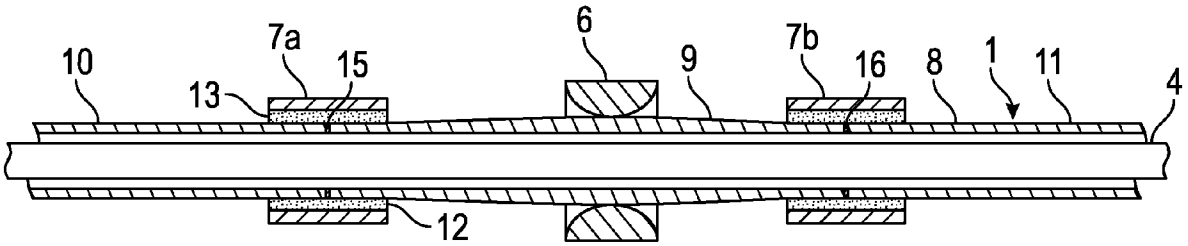
FIG. 4 is a side cross-sectional schematic diagram illustrating the pull tube, pull tube guide, and pull tube stress joint sleeves.
Figure 5:
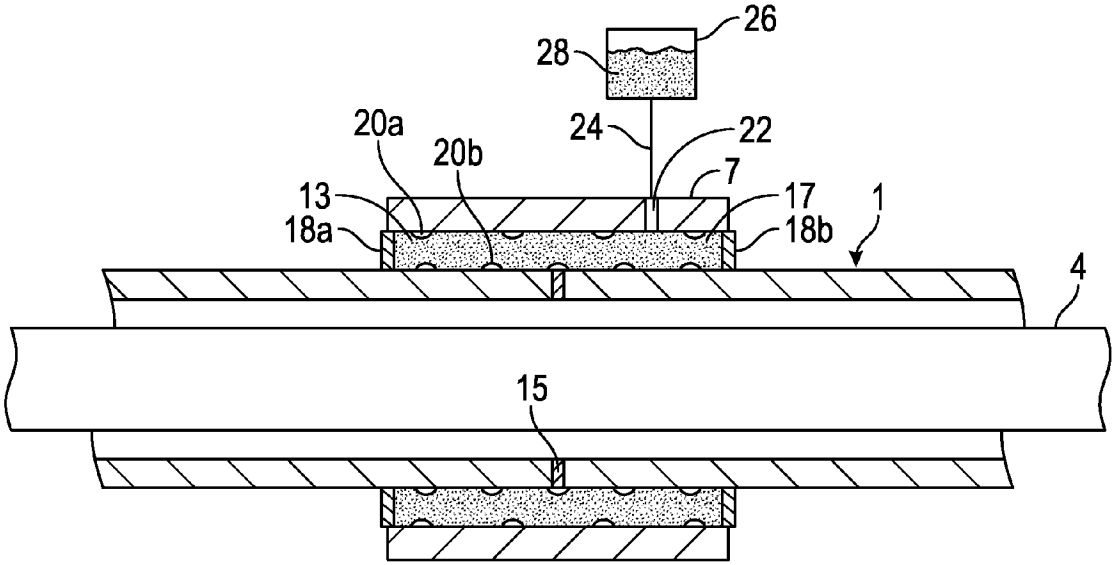
FIG. 5 is a detail side cross-sectional view schematic diagram illustrating an exemplary embodiment of a pull tube stress joint assembly of FIG. 4.

FIG. 3 is a side view schematic diagram illustrating the pull tube with the pull tube stress joint sleeves. FIG. 4 is a side cross-sectional view schematic diagram illustrating the pull tube, pull tube guide, and pull tube stress joint sleeves. FIG. 5 is a detail side cross-sectional view schematic diagram illustrating an exemplary embodiment of a pull tube stress joint assembly of FIG. 4. The figures will be described in conjunction with each other. Multiple segments, such as segments 8, 9, 10, 11, and 12, form the pull tube 1. The segments are welded together to form welded connections, such as welded connections 15 and 16, between the segments, where the pull tube 1 extends longitudinally both directions from the welded connections. Some segments, such as segment 9, can have different wall thicknesses to provide additional strength in high stress portions of the pull tube. While the pull tube 1 itself may be able to withstand bending stresses as the catenary riser 4 moves back and forth within the pull tube, the welded connections without special precautions closest to the pull tube guide 6 incur higher stresses and may fatigue and fail. Typically, expensive Class C welds are required for these welded connections as explained in the above background section. Without limitations, exemplary lengths of segments are shown as 40 feet (12 meters), and other lengths are possible.

However, the present invention allows use of more standard welds. In at least one embodiment, a portion of the segment 9 with the thickest wall in close proximity to the guide 6 is not welded and thus no welded connection is subject to the full stress of the bending of the pull tube 1 in the guide 6 as a focal point of the bending stress. At the ends of the segment 9, the segments 8 and 10 can be welded to form welded connections 15, 16. As the pull tube extends further away from the guide 6, the stresses lessen on the pull tube and welded connections of further segments of the pull tube may not be sufficiently stressed to warrant the use of a sleeve 7 around such further welded connections.

One or more pull tube stress joint sleeves 7A, 7B can be coupled to the pull tube 1 at the welded connections 15, 16. The sleeves 7 are disposed around a length of the pull tube at the welded connections. The sleeve extends longitudinally on both sides of the welded connection. The sleeves have an outer diameter surface and an inner diameter surface, where the sleeve inner diameter surface is larger than the pull tube outer diameter surface and forms a generally annular space 17 therebetween that is filled as explained herein. While the number of sleeves can vary from one to several, it is envisioned that generally a sleeve can be advantageously used at each of the nearest welded connections along the length of the pull tube as the pull tube extends from the guide 6.

A quantity of hardenable fill material 13 is coupled between the inner diameter surface of the sleeve 7 and the outer diameter surface of the pull tube 1 to fill a cross section of the annular space between the two surfaces. Without limitation, the fill material can be concrete, grout, or other cement-based materials; rubberized materials, including rubberized grout; polymeric materials, such as epoxies and phenolics; and other materials that can be filled into the space between the sleeve and the pull tube to provide a supportive coupling between the sleeve and the pull tube. The purpose of the fill material is to transfer the bending load of the pull tube near the welded connection to the sleeve surrounding the pull tube. Thus, a hard fill material is envisioned rather than a pliable and flexible material.

In at least one embodiment, the fill material can initially be a fluid that can be poured or injected into the space 17 and then hardened to function as described. One or more annular stoppers 18A, 18B can be positioned such as at the ends of the sleeve 7 to block one or more ends of the space 17 to retain the fluid fill material in the space at least until the fill material can sufficiently harden. An inlet 22 can be formed in the sleeve 7, the stopper 18, or other appropriate location to facilitate filling of the space 17. A line 24 can be coupled from the inlet 22 to a tank 26 of a flowable fill material 28. A pump (not shown) can be used to transfer the fill material from the tank 26 to the space 17. In general, it is advantageous to fill the entire space 17 with the fill material to be able to transfer a full load from the pull tube into the sleeve to diffuse the stress on the pull tube. However, some portion of the space between the sleeve 7 and the pull tube 1 may not have a complete filling and the term "fill" or "filling" and the like herein is not restricted to a complete filling of every portion of the space 17 by the fill material 13, but is meant to include filling of the space across at least one cross section between the sleeve and the pull tube.

The sleeve 7, the pull tube 1, or both can also have one or more gripping surfaces 20 formed in or on their surfaces, such as indentions 20A, ribs and projections 20B, or other surface irregularities above or below the nominal surface of the sleeve and/or pull tube. The gripping surfaces assist in restraining the fill material in position between the sleeve and pull tube and restraining the sleeve relative to the pull tube.

In the following embodiments, the sleeve 7 is initially in multiple portions and is assembled onto the pull tube 1 to function similar as has been described above.

Figure 6:
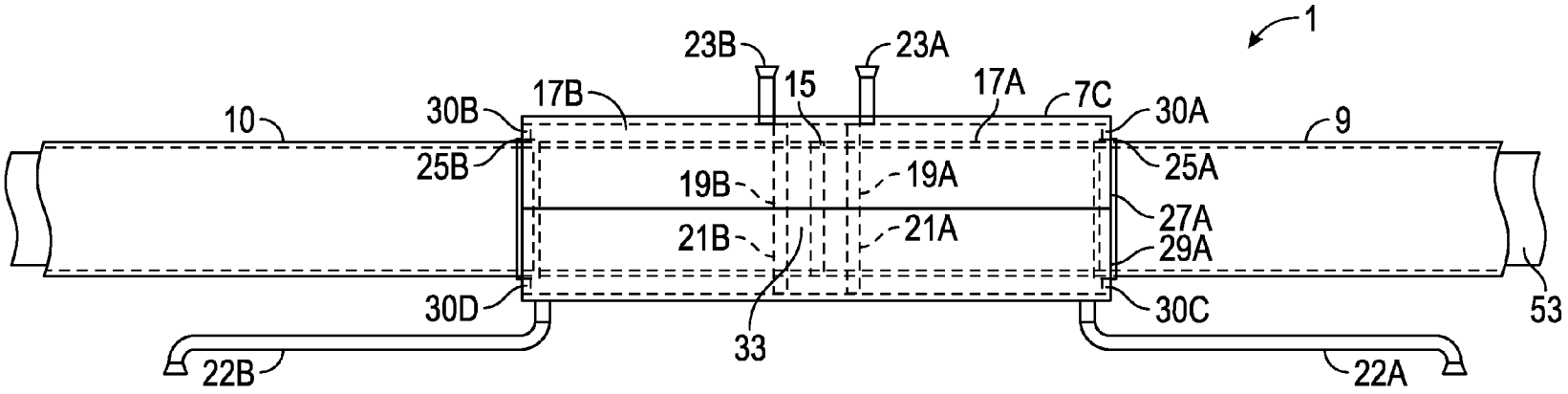
FIG. 6 is a side view schematic diagram of another embodiment of the pull tube stress joint sleeve and a pull tube.
Figure 7:
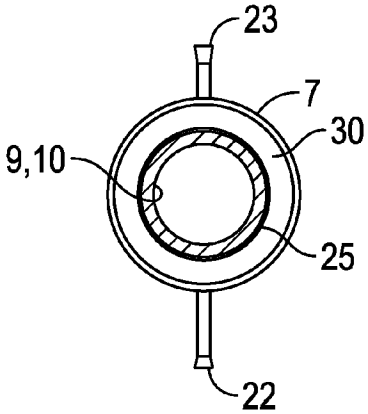
FIG. 7 is an end view schematic diagram of the embodiment shown in FIG. 6.

FIG. 6 is a side view schematic diagram of another embodiment of the pull tube stress joint sleeve and a pull tube. FIG. 7 is an end view schematic diagram of the embodiment shown in FIG. 6. The figures will be described in conjunction with each other. For illustrative purposes, the pull tube 1 with a riser 53 disposed therein includes the pull tube segment 9 on the right side of the figure and the pull tube 10 on the left side of the figure. The welded connection 15 is illustrated in the middle of the figure between the pull tube segments 9, 10. Also, for illustrative purposes, the pull tube segment 9 is larger in diameter than the pull tube segment 10. A sleeve 7C can be formed from a plurality of portions, such as a first sleeve portion 27A and a second sleeve portion 29A, and more portions can be used, such as three, four and more to form the sleeve 7C or other sleeves 7. As explained below, the portions are coupled to form an annular space around the pull tube 1 into which fill material can be placed, as described above. In the exemplary embodiment, an annular space 17A is formed on the right side of the sleeve and another annular space 17B is formed on the left side of the sleeve with the void space 33 formed therebetween. The void space 33 is bounded by a first ring 19A coupled to the first sleeve portion 27A and a first ring 21A coupled to the second sleeve portion 29A on one side of the void space 33. The void space 33 is bounded on the other side by a segment ring 19B coupled to the first sleeve portion 27A and a second ring 21B coupled to the second sleeve portion 29A. On the right side of the sleeve, a stopper 30A seals the annular gap between the outer diameter of the pull tube segment 9 and the inner diameter of the sleeve 7C. Similarly, the left side of the sleeve is sealed in the annular gap by a stopper 30B. In some embodiments, a flexible seal 25 may be placed between the stopper 30 and the pull tube, such as seal 25A on the right side of the figure and the seal 25B on the left side of the figure. The seal 25 can assist in restraining the fill material from extruding outward from the sleeve between the pull tube 1 and the stopper 30. A fill inlet 22A is coupled to generally a lower portion of the sleeve 7C to fill the annular space 17A. A fill outlet 23A allows air and other undesired material in the annular space 17A to exit the space as the fill material flows through the inlet 22A into the annular space. Generally, the outlet 23A will be disposed in an upper portion of the sleeve 7C, so that fill material entering through the inlet 22A can substantially fill the annular space 17A. Similarly, the annular space 17B can be filled through an inlet 22B and undesired materials can exit through the outlet 23B.

The following figures illustrate at least one exemplary method of forming the sleeve 7C around the pull tube 1.

Figure 8A:
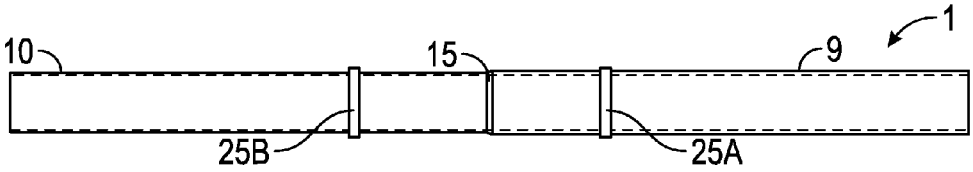
FIG. 8A is a side view schematic diagram of an exemplary pull tube.

FIG. 8A is a side view schematic diagram of an exemplary pull tube. The exemplary pull tube 1 includes the pull tube segment 9 and the pull tube segment 10 with a welded connection 15 formed at the junction of the two segments. Optionally, the plurality of seals 25A, 25B can be disposed around the diameter of the pull tube 1 at locations that correspond to the sleeve surfaces that enclose the diameter of the pull tube 1.

Figure 8B:
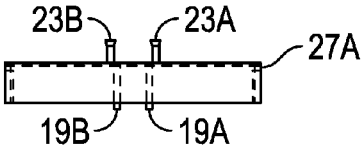
FIG. 8B is a side view schematic diagram of a portion of the exemplary pull tube stress joint sleeve.
Figure 8C:
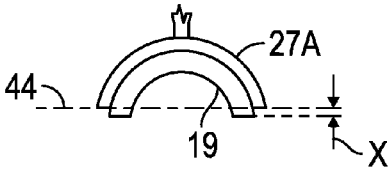
FIG. 8C is an end view schematic diagram of a first sleeve portion with rings.

FIG. 8B is a side view schematic diagram of a portion of a first sleeve portion of the exemplary pull tube stress joint sleeve. FIG. 8C is an end view schematic diagram of a first sleeve portion with rings. The figures will be described in conjunction with each other. The rings 19A, 19B are formed to fit the inner radius of the first sleeve portion 27A and the outer radius of the pull tube segment to which the rings will engage. In the illustration, the inner diameter of the ring 19A would fit the outer diameter of the pull tube segment 9, while the inner diameter of the ring 19B would fit the outer diameter of the pull tube segment 10. To assist in coupling the rings to the pull tube, the rings 19A, 19B can extend circumferentially slightly below the lateral edges at line 44 of the first sleeve portion 27A by a dimension "X". The sleeve portion 27A can also include the outlets 23 described above that are located laterally outward from the rings 19.

Figure 8D:
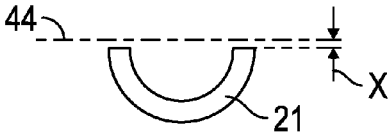
FIG. 8D is an end view schematic diagram of rings for the second sleeve portion.

FIG. 8D is an end view schematic diagram of rings for the second sleeve portion. The rings 21 can be similar to the rings 19 in FIG. 8C. An inner radius of the rings can fit the particular outer diameter of the pull tube segment to which the rings engage, and the outer radius of the rings can fit the inner radius of the second sleeve portion 29A. The rings 21 can be slightly reduced in circumferential length to allow for the extended circumferential length of the rings 19 around the pull tube segment by the dimension "X" shown in FIG. 8C with a corresponding dimension "X" below the line 44 shown in FIG. 8D.

Figure 8E:
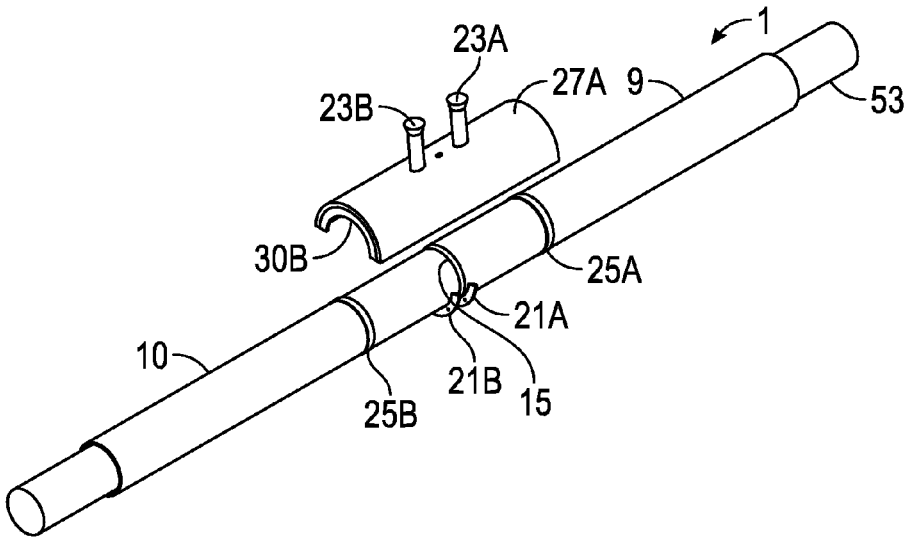
FIG. 8E is a perspective schematic diagram of a partially assembled sleeve with rings and a sleeve portion for the pull tube.
Figure 8F:
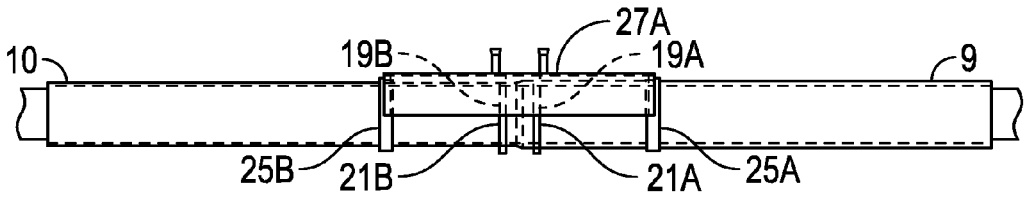
FIG. 8F is a side view schematic diagram of the portion of the sleeve in FIG. 8E assembled to the pull tube.

FIG. 8E is a perspective schematic diagram of a partially assembled sleeve with rings and a sleeve portion for the pull tube. FIG. 8F is a side view schematic diagram of the portion of the sleeve in FIG. 8E assembled to the pull tube. The figures will be described in conjunction with each other. In at least one embodiment, the rings 21 are not coupled to the second sleeve portion initially, but are coupled to the pull tube segments by any suitable means, including welding or other fastening. Generally, the rings will be coupled on opposite sides of the welded connection 15. The rings 21 become an anchoring structure for the rest of the sleeve assembly in at least this embodiment. The first sleeve portion 27A can be coupled to the pull tube and engage the optional seals 25A, 25B with the stoppers 30 on each end of the sleeve portion. The first sleeve portion 27A can include outlets 23A, 23B for fluid in the space between the sleeve and the pull tube as fill material enters the space. The circumferentially extended ends of the rings 19A, 19B can be coupled to the ends of the rings 21A, 21B, such as by welding or other fastening. Thus, the first sleeve portion is coupled to the pull tube through the rings 19 coupled to the rings 21 and, in at least one embodiment, the rings 19 do not need welding or fastening directly to the pull tube.

Figure 8G:
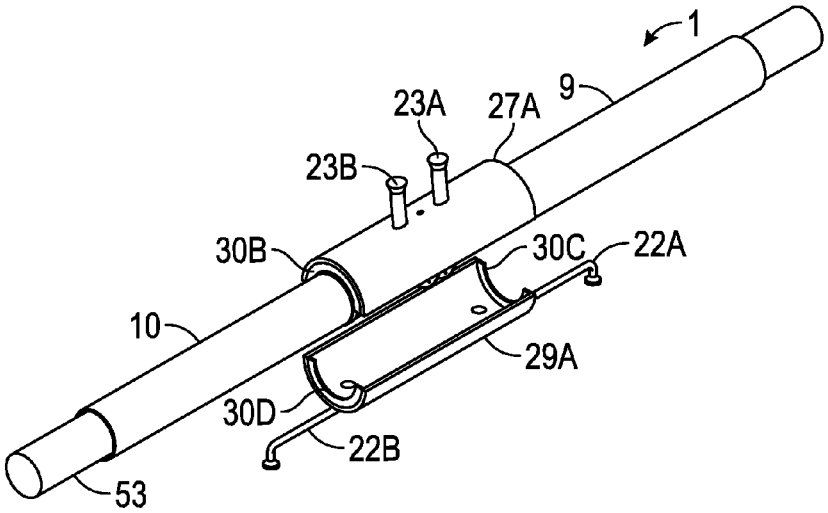
FIG. 8G is a perspective schematic diagram of a partially assembled sleeve with another sleeve portion for the pull tube.
Figure 8H:
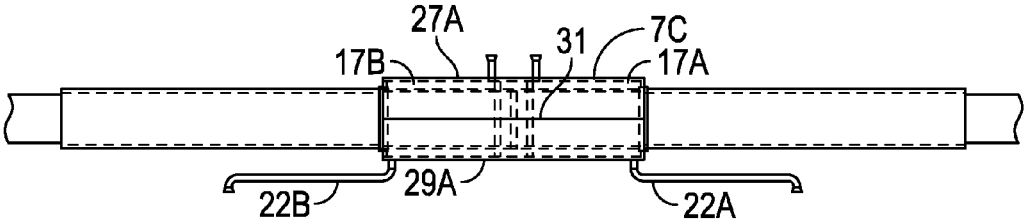
FIG. 8H is a side view schematic diagram of the sleeve assembled to the pull tube.

FIG. 8G is a perspective schematic diagram of a partially assembled sleeve with another sleeve portion for the pull tube. FIG. 8H is a side view schematic diagram of the sleeve assembled to the pull tube. The figures will be described in conjunction with each other. A second sleeve portion 29A can be coupled with the pull tube 1. The second sleeve portion 29A can be placed in position over the rings 21 and coupled to the first sleeve portion 27A, such as by coupling the sleeve portions at the joint 31 by welding or other fastening. The second sleeve portion 29A includes the inlets 22A, 22B. The rings 21 do not need to be welded or otherwise fastened directly to the second sleeve portion 29A because the sleeve portion 29A is coupled with the sleeve portion 27A. The sleeve portion 27A is coupled to the rings 19. The rings 19 are coupled to the rings 21, and the rings 21 are coupled to the pull tube 1.

Figure 8I:
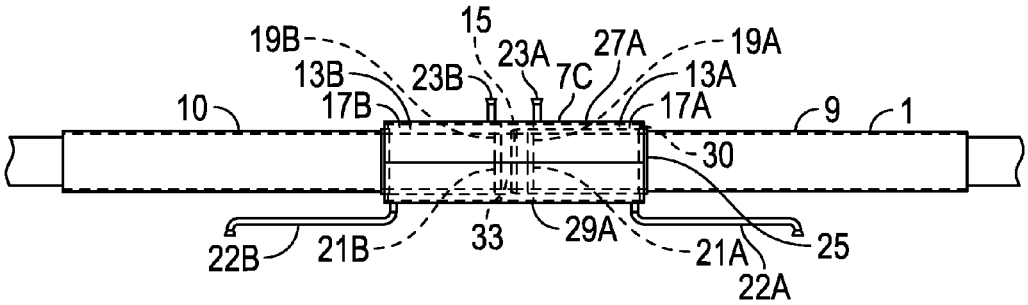
FIG. 8I is a side view schematic diagram of the assembled sleeve with the sleeve portions coupled together to the pull tube and a fill material between the pull tube and the sleeve.

FIG. 8I is a side view schematic diagram of the assembled sleeve with the sleeve portions coupled together to the pull tube and a fill material between the pull tube and the sleeve. The sleeve 7C is assembled onto the pull tube segments 9, 10. The stoppers 30 can engage the seals 25 and block the annular spaces 17A, 17B during the filling of the fill material. The seals 25 can soften or absorb some localized high stress caused by the interaction of the ends of the sleeve joint with the pull tube during bending movement while in operation. A void space 33 is formed around the welded connection 15 from the combination of the rings 19A, 21A on one side of the space and the combination of the rings 19B, 21B on the other side of the space. The annular space 17A can be filled with a fill material 13A, and the annular space 17B can be filled with a fill material 13B. When hardened, the fill material assists in distributing the stress load from the pull tube into the stress joint sleeve and avoid causing localized stress on the pull tube. The fill material advantageously has a Young's modulus that is smaller than that of the sleeve and the pull tube to avoid localized high stress loads.

Figure 9:
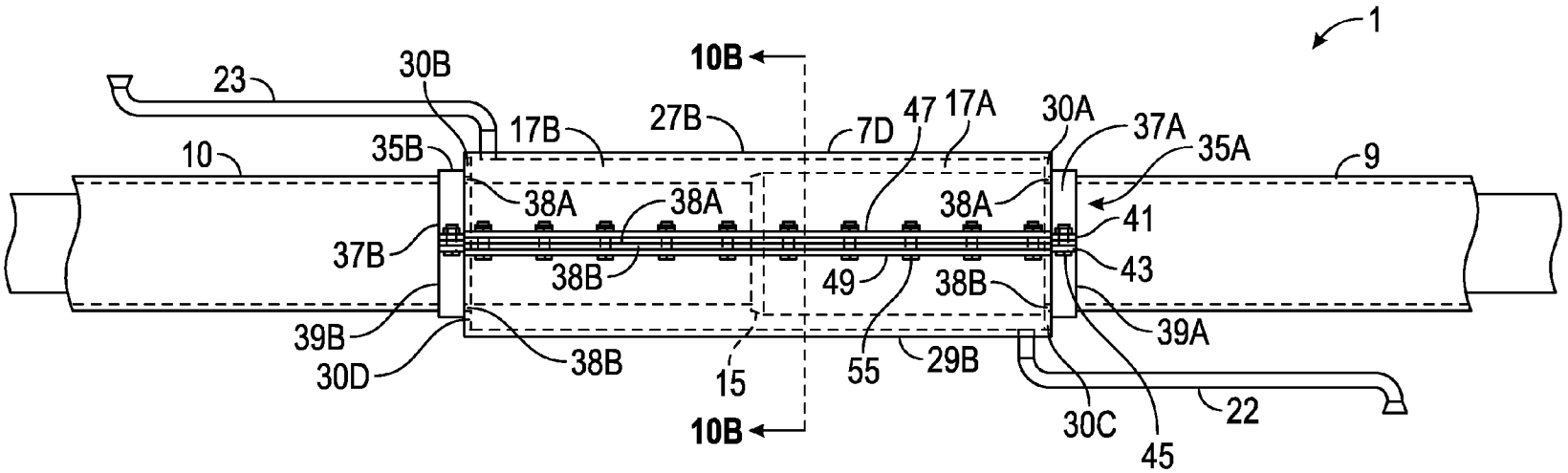
FIG. 9 is a side view schematic diagram of another embodiment of the pull tube stress joint sleeve and a pull tube.
Figure 10B:
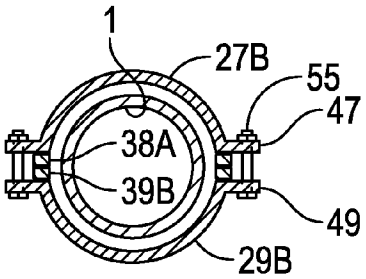
FIG. 10B is an exemplary cross-sectional schematic diagram of the stress joint sleeve and the pull tube in FIG. 9.
Figure 10A:
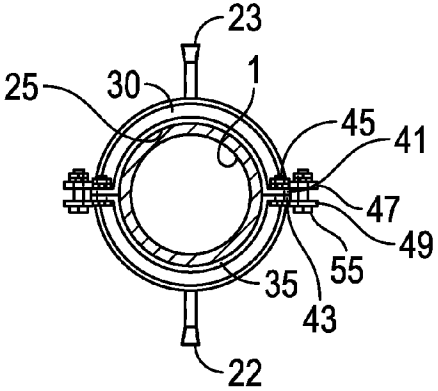
FIG. 10A is an end view schematic diagram of a stress joint sleeve having a plurality of sleeve portions coupled to the exemplary pull tube in FIG. 9.

FIG. 9 is a side view schematic diagram of another embodiment of the pull tube stress joint sleeve and a pull tube. FIG. 10A is an end view schematic diagram of a stress joint sleeve having a plurality of sleeve portions coupled to the exemplary pull tube in FIG. 9. FIG. 10B is an exemplary cross-sectional schematic diagram of the stress joint sleeve and the pull tube in FIG. 9. The figures will be described in conjunction with each other. The pull tube stress joint sleeve 7D can be formed by a plurality of portions that are fastened together by fasteners and can be held in longitudinal position by clamps. The number of portions can vary in this and other embodiments described herein. For illustrative purposes, an exemplary embodiment includes a first sleeve portion 27B and a second sleeve portion 29B. The sleeve 7D can be coupled over the pull tube segment 9, the pull tube segment 10, and a connection 15 between the segments, and the pull tube segments have different outer diameters for illustrative purposes. In this embodiment, fasteners 55, such as bolts and nuts, pins, rivets, and other fasteners, can couple the sleeve portions together. Generally, the sleeve 7D will be positioned, so that the welded connection 15 between the pull tube segment 9 and the pull tube segment 10 will be disposed in the middle of the sleeve, although the position can vary depending on the stress distribution among other factors. The sleeve 7D forms an annular space 17A between the outer diameter of the pull tube segment 9 and the inner diameter of the sleeve 7D, and an annular space 17B between the outer diameter of the pull tube segment 10 and the inner diameter of the sleeve 7D. The annular spaces 17A, 17B can differ in volume due to the difference in outer diameters between the pull tube segment 9 and the pull tube segment 10.

An inlet 22 allows fill material to flow into the annular spaces 17. An outlet 23 allows undesired materials to flow out of the annular spaces 17, when the fill material is flowing into the annular spaces.

The first sleeve portion 27B can include a sleeve extension 47 that laterally extends outward from the sleeve portion on both longitudinal sides of the sleeve. Similarly, the second sleeve portion 29B can include a sleeve extension 49 that laterally extends outward from the sleeve portion on both longitudinal sides of the sleeve. The sleeve extensions 47, 49 can include openings formed in alignment to accept fasteners 55 therethrough to couple the extensions.

One or more seals 38 can be disposed between the sleeve portions 27B, 29B and the pull tube 1 at each end, and between the sleeve extensions 47, 49 along the length of the sleeve. For example, a seal 38A can be disposed between each end of the first sleeve portion 27B and the respective pull tube segments 9, 10, and then along the length of the sleeve extension 47 of the first sleeve portion 27B. Similarly, a seal 38B can be disposed between each end of the second sleeve portion 29B and the respective pull tube segments 9, 10, and then along the length of the sleeve extension 49 of the second sleeve portion 27B. When the sleeve 7D is assembled, the seals 38A, 38B can seal together along the interface between the sleeve extensions 47, 49.

Figure 13A:
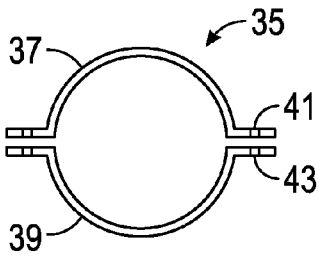
FIG. 13A is an end view schematic diagram of an exemplary clamp for the sleeve.
Figure 13B:
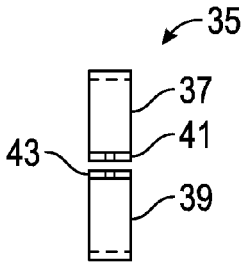
FIG. 13B is a side view schematic diagram of the exemplary clamp of FIG. 13A.

To retain the longitudinal position of the sleeve 7D along the pull tube 1, one or more clamps 35 can be used on at least one end, and advantageously both ends, of the sleeve 7D. For example, a clamp 35A can be used on one end of the sleeve 7D and a clamp 35B used on the other end of the sleeve, where each clamp is sized to fit the diameter of the respective pull tube segments 9, 10. The clamps 35 can be formed in a plurality of portions, similar to the sleeve, to encircle the periphery of the pull tube. For the exemplary clamp 35A, a first portion 37A and a second portion 39A can be used, although the number of portions can vary. Each portion 37A, 39A of the clamp 35A can include mating clamp extensions 41, 43, respectively, that extend laterally outward from the clamp. The clamp extensions 41, 43 can include openings formed in alignment therethrough to accept fasteners 45 to couple the clamp extensions and thereby the clamp portions. Similarly, the exemplary clamp 35B can be formed by a first portion 37B and a second portion 39B with similar mating clamp extensions that extend laterally outward from the clamp. A further illustration of the claim 15 is shown in FIGS. 13A, 13B.

Figure 11A:
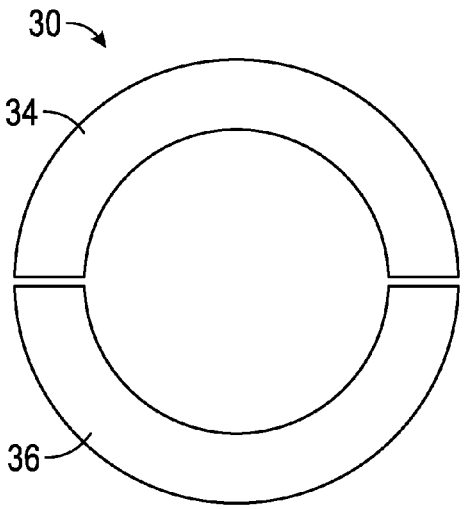
FIG. 11A is an end view schematic diagram of an exemplary stopper for the sleeve with a plurality of portions.
Figure 11B:
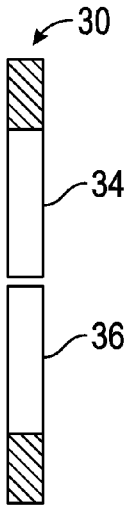
FIG. 11B is a side view cross-sectional schematic diagram of the stopper of FIG. 11A.

FIG. 11A is an end view schematic diagram of an exemplary stopper for the sleeve with a plurality of portions. FIG. 11B is a side view cross-sectional schematic diagram of the stopper of FIG. 11A. The figures will be described in conjunction with each other. The stopper 30 can be a ring-shaped structure having dimensions that can fill an end of the annular space 17 between one or more of the sleeves 7 described herein in conjunction with any seals used for the particular embodiment. The stopper 30 can be formed in one, two, or more portions. In the embodiment shown, a first stopper portion 34 and a second stopper portion 36 can be used to form the stopper 30 around the diameter of the pull tube and a seal that may be used.

Figure 12A:
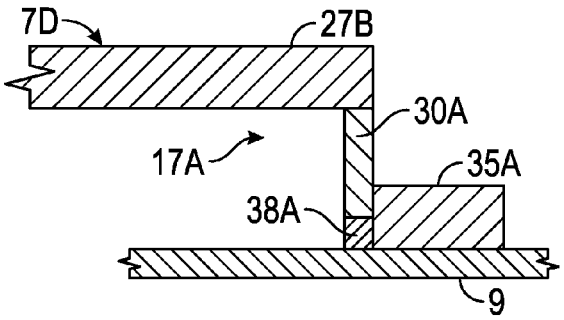
FIG. 12A is a detail side cross-sectional schematic diagram of a clamp, sleeve, and pull tube assembly on one end of the sleeve of FIG. 9.

FIG. 12A is a detail side cross-sectional schematic diagram of a clamp, sleeve, and pull tube assembly on one end of the sleeve of FIG. 9. The sleeve portion 27B of the sleeve 7D is shown radially outward from the periphery of the pull tube segment 9. A stopper 30A is coupled to the sleeve portion 27A. An outer radius of the stopper 30A is generally sized to fit an inner radius of the sleeve portion 27A. The stopper 30A assists in longitudinally restraining the fill material as it flows into the space 17A, as described herein. A seal 38A can be disposed between an inner radius of the stopper 30A and the outer diameter of the pull tube segment 9. The stopper 30A can be formed with an inner radius to fit the outer diameter of the seal 38A and the respective pull tube segment. The clamp 35A can be longitudinally positioned adjacent the stopper 30A to retain the sleeve portion in position on the pull tube. The clamp 35A can be formed with an inner radius to fit the outer diameter of the respective pull tube segment.

Figure 12B:
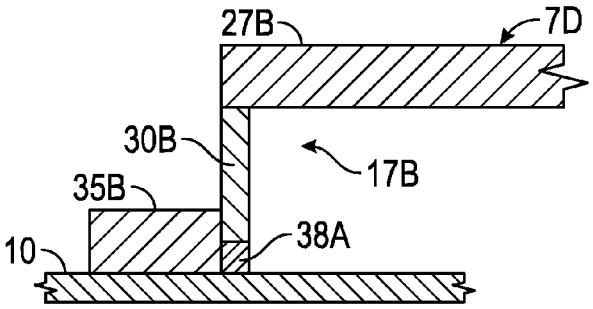
FIG. 12B is a detail side cross-sectional schematic diagram of a clamp, sleeve, and pull tube assembly on another end of the sleeve of FIG. 9.

FIG. 12B is a detail side cross-sectional schematic diagram of a clamp, sleeve, and pull tube assembly on another end of the sleeve of FIG. 9. The sleeve portion 27B of the sleeve 7D is shown radially outward from the periphery of the pull tube segment 10. A stopper 30B is coupled to the sleeve portion 27A. An outer radius of the stopper 30B is generally sized to fit an inner radius of the sleeve portion 27A. The stopper 30B assists in longitudinally restraining the fill material as it flows into the space 17B, as described herein. A seal 38A can be disposed between an inner radius of the stopper 30B and the outer diameter of the pull tube segment 10. The stopper 30B can be formed with an inner radius to fit the outer diameter of the seal 38A and the respective pull tube segment. The clamp 35B can be longitudinally positioned adjacent the stopper 30B to retain the sleeve portion in position on the pull tube. The clamp 35B can be formed with an inner radius to fit the outer diameter of the respective pull tube segment.

An alternative configuration is to use a sleeve that has a varying inner radius that adjusts to the change in outer diameters of the pull tube segments, so that the annular space 17 has the same radial distance between the respective pull tube segment and the sleeve. Therefore, the thickness of the stoppers 30A, 30B could be the same, even though the inner and outer diameters of the stoppers would be different. Other variations are envisioned with the general goal to close the end of the sleeve adjacent the respective pull tube segment.

FIG. 13A is an end view schematic diagram of an exemplary clamp for the sleeve. FIG. 13B is a side view schematic diagram of the exemplary clamp of FIG. 13A. The figures will be described in conjunction with each other. The clamp 35 can be formed with a plurality of clamp portions 37, 39, or other numbers of portions. The clamp extensions 41, 44 can extend radially outward with aligned openings formed therethrough to allow insertion of fasteners to couple the clamp portions 37, 39 to form the clamp 35, where generally the clamp portions will be symmetrical. The inner radius of the clamp can be sized to the outer diameter of the pull tube segment to which the clamp is positioned.

Figure 14:
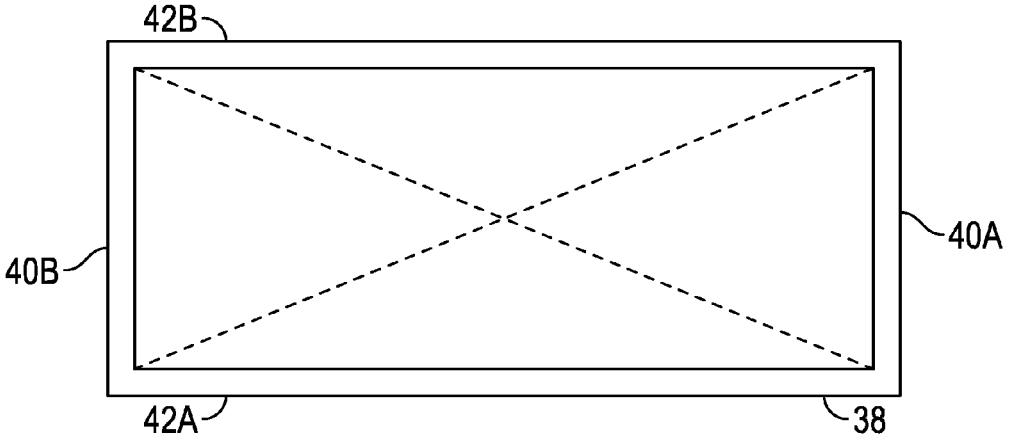
FIG. 14 is a top view schematic diagram of a seal used between the first and second sleeve portions and the pull tube.

FIG. 14 is a top view schematic diagram of a seal used between the first and second sleeve portions and the pull tube. The seal 38 includes a seal end 40A and another seal end 40B that are sized to be disposed between the inner radius of the stopper 30 described herein and the outer diameter of the pull tube 1 and its respective pull tube segments 9, 10. Seal sides 42A, 42B are formed between the seal ends and are intended to be disposed between the sleeve extensions 47, 49 described herein when the sleeve is assembled. In some embodiments, such as when using different diameter pull tube segments, the seal 38 can be formed into separate individual portions, 40A, 40B, 42A, 42B to allow for different lengths of the seal ends. The separate portions of the seal can be assembled with the respective sleeve portions to create the overall seal 38 for the sleeve.

The following figures illustrate at least one exemplary method of forming the sleeve 7D around the pull tube 1.

Figure 15A:
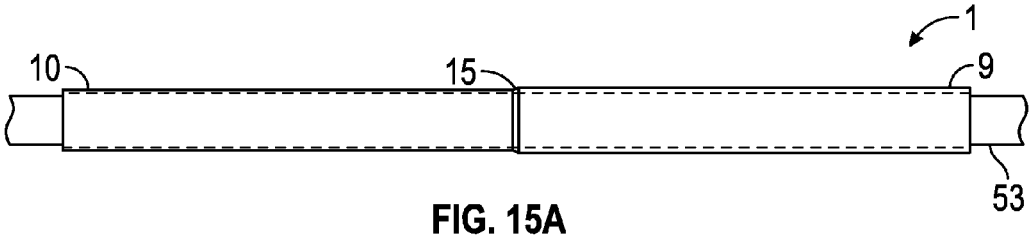
FIG. 15A is a side view schematic diagram of an exemplary pull tube.

FIG. 15A is a side view schematic diagram of an exemplary pull tube. The exemplary pull tube 1 includes the pull tube segment 9 and the pull tube segment 10 with a welded connection 15 formed at the junction of the two segments. A riser 53 extends through the pull tube 1.

Figure 15B:
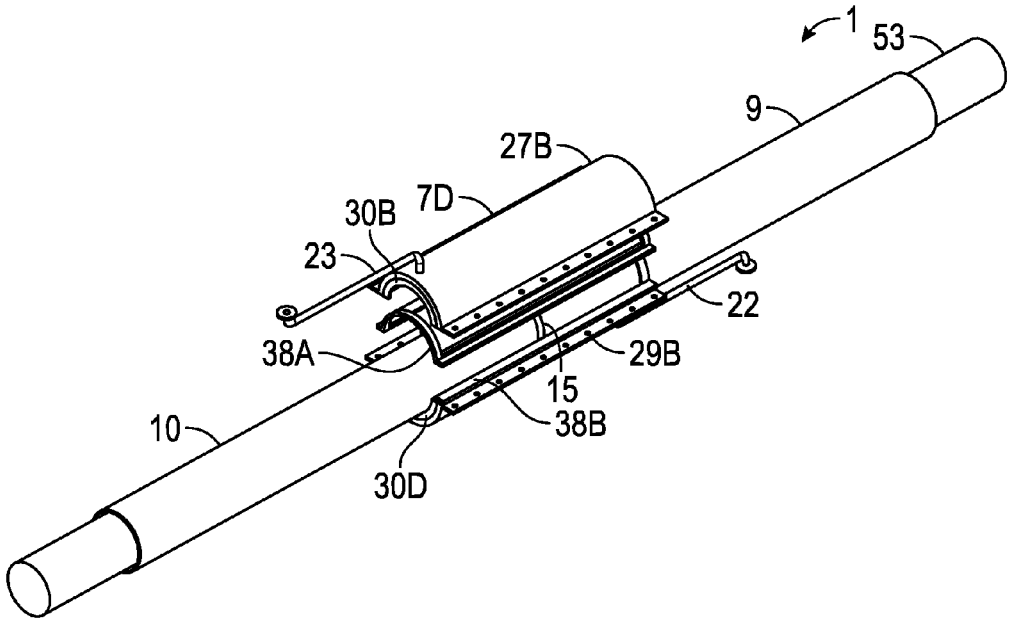
FIG. 15B is a perspective schematic diagram of a partially assembled sleeve with a plurality of portions of the exemplary pull tube stress joint sleeve on a pull tube with a seal disposed therebetween.

FIG. 15B is a perspective schematic diagram of a partially assembled sleeve with a plurality of portions of the exemplary pull tube stress joint sleeve on a pull tube with a seal therebetween. The sleeve portions 27A, 29B can be disposed longitudinally, so that the welded connection 15 is generally in the middle of the sleeve when assembled on the pull tube 1, so that the sleeve can provide stress reduction for the pull tube in a symmetrical manner on either side of the welded connection. Other positions along the pull tube are contemplated, for example, if one side may have greater stress and a longer portion of the sleeve is beneficial to that portion. A seal 38A can be disposed between the sleeve portion 27B and the pull tube 1 and a seal 38B can be disposed between the sleeve portion 29B and the pull tube. The seals can be glued or otherwise coupled with the respective sleeve portions, or the seals can be preinstalled on the pull tube. The seal sides of the seals 38A, 38B generally will be sealed against each other when the sleeve portions 27B, 29B are coupled together around the pull tube. Variations in the seal 38 are contemplated, such as one seal having only the ends and the other seal having the ends and sides and the sleeve portions be sized to seal against the one set of seal sides.

A first sleeve portion 27B and a second sleeve portion 29B can be equipped with an inlet 22 on one of the portions and an outlet 23 on another of the portions. Generally, the inlet 22 will be located in a lower portion of the sleeve 7D upon assembly. As the fill material flows into the annular space 17 described below, the fill material will fill substantially the available volume as it progresses upward through the annular space before encountering the outlet 23. The outlet is generally located in an upper portion of the sleeve 7D upon assembly.

Figure 15C:
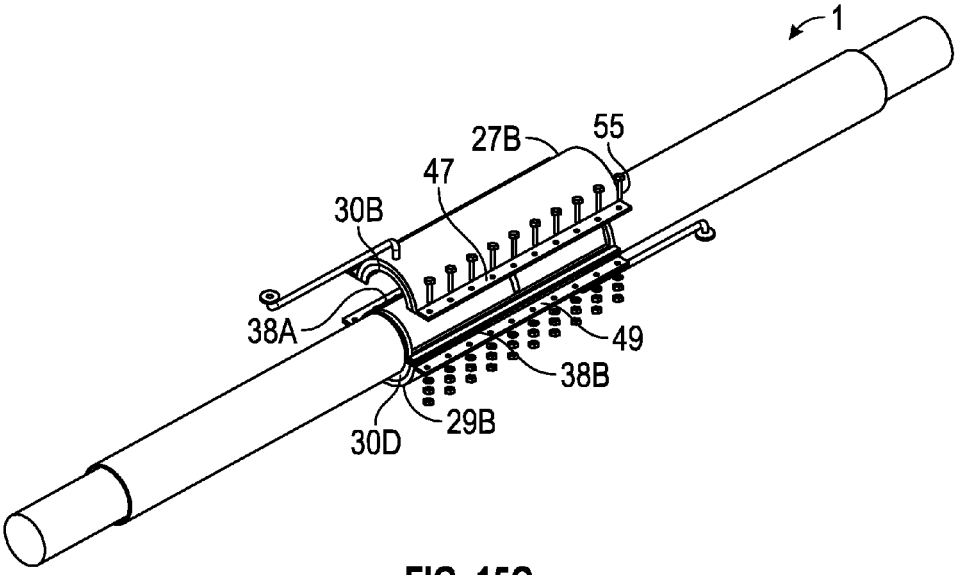
FIG. 15C is a perspective schematic diagram of the partially assembled sleeve on a pull tube with a seal located in position and fasteners shown for assembly.

FIG. 15C is a perspective schematic diagram of the partially assembled sleeve on a pull tube with one or more seals located in position and fasteners shown for assembly. After the sleeve portions 27B, 29B are positioned with appropriate seals 38, the sleeve portions can be fastened together by fasteners 55 through the sleeve extensions 47, 49. The fasteners can be pre-tensioned, so that if the fill material shrinks, the sleeve portions are still tightly coupled to the pull tube around the fill material.

Figure 15D:
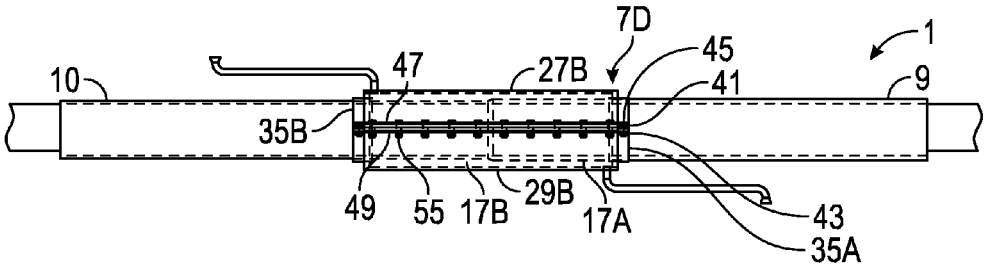
FIG. 15D is a side view schematic diagram of the portions of the sleeve assembled to the pull tube.

FIG. 15D is a side view schematic diagram of the portions of the sleeve assembled to the pull tube. In some embodiments, at least one of the clamps 35 can be assembled with the clamps portions 37, 39 around the perimeter of the pull tube 1 adjacent the ends of the pull tube stress joint sleeve 7D. The clamps assist in retaining the sleeve in an appropriate longitudinal position on the pull tube. The fasteners 45 can be installed through the clamp extensions 41, 43 to couple the clamp portions 37, 39 together. Upon assembly of the sleeve with the pull tube, an annular space 17A is formed between the sleeve and the pull tube segment 9, and an annular space 17B is formed between the sleeve and the pull tube segment 10.

Figure 15E:
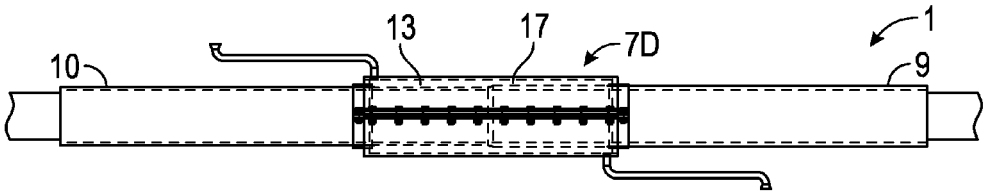
FIG. 15E is a side view schematic diagram of the assembled sleeve with the portions coupled together with fill material inserted into the space between the sleeve and the pull tube.

FIG. 15E is a side view schematic diagram of the assembled sleeve with the portions coupled together with fill material inserted into the space between the sleeve and the pull tube. With the sleeve 7D assembled onto the pull tube 1, the fill material 13 can be used to fill the annular space 17 between the pull tube 1 and the pull tube stress joint sleeve 7D. Without limitation, a filled annular space 17 can be indicated when the fill material starts to exit the outlet 23.

Other and further embodiments utilizing one or more aspects of the inventions described above can be devised without departing from the spirit of the disclosed invention. For example and without limitation, the pull tubes, sleeves, and components thereof, can be round or other geometric shapes, so that the use of the terms "diameter" and "radius" is to be construed broadly to relate to an inner or outer periphery, as the case may be, that may or may not be round. The embodiments have generally been described in terms of welding, because the general state of the art is conducive to welding, but the invention is not limited to welding and can include any suitable form of coupling, such as clamping, fastening, and other coupling means. Further, the use of a sleeve as a stress joint around the pull tube within the pull tube guide is contemplated and can be in addition to the pull tube stress joint sleeves around the welded connection described herein.

Further, the various methods and embodiments of the system can be included in combination with each other to produce variations of the disclosed methods and embodiments. Discussion of singular elements can include plural elements and vice-versa. References to at least one item followed by a reference to the item may include one or more items. Also, various aspects of the embodiments could be used in conjunction with each other to accomplish the understood goals of the disclosure. Unless the context requires otherwise, the word "comprise" or variations such as "comprises" or "comprising," should be understood to imply the inclusion of at least the stated element or step or group of elements or steps or equivalents thereof, and not the exclusion of a greater numerical quantity or any other element or step or group of elements or steps or equivalents thereof. The device or system may be used in a number of directions and orientations. The term "coupled," "coupling," "coupler," and like terms are used broadly herein and may include any method or device for securing, binding, bonding, fastening, attaching, joining, inserting therein, forming thereon or therein, communicating, or otherwise associating, for example, mechanically, magnetically, electrically, chemically, operably, directly or indirectly with intermediate elements, one or more pieces of members together and may further include without limitation integrally forming one functional member with another in a unity fashion. The coupling may occur in any direction, including rotationally.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicant, but rather, in conformity with the patent laws, Applicant intends to protect fully all such modifications and improvements that come within the scope or range of equivalent of the following claims.

What is claimed is:

1. A system for supporting a catenary riser coupled to an offshore platform, comprising:

a pull tube having an outer diameter surface and an inner diameter surface, the inner diameter surface being sized to allow the riser to pass therethrough;

the pull tube having a lower end disposed downward from the offshore platform and at an upper portion distal from the lower end disposed toward the offshore platform; and the pull tube further having one or more segments welded together to establish one or more welded connections with the pull tube extending longitudinally on both sides of the welded connections;

a pull tube guide coupled to the offshore platform and coupled to the outer diameter surface of the pull tube between the lower end and the upper portion;

a first pull tube stress joint sleeve disposed around a length of the pull tube at a first welded connection and longitudinally extending on both sides of the first welded connection, the sleeve having an outer diameter surface and an inner diameter surface, the sleeve inner diameter surface being larger than the pull tube outer diameter surface to form an annular gap between the two surfaces, the pull tube stress joint sleeve comprising a plurality of sleeve portions configured to be sealingly coupled together along a longitudinal side of the sleeve portions to form the pull tube stress joint sleeve around the pull tube and further comprising stoppers disposed in the annular gap independent of the riser between the sleeve inner diameter surface and the pull tube outer diameter surface; and a first quantity of fill material coupled between the sleeve inner diameter surface and the pull tube outer diameter surface to fill a cross section of the annular gap.

2. The system of claim 1, wherein the sleeve, the pull tube at the first welded connection, or a combination thereof have one or more gripping surfaces configured to provide displacement resistance to the fill material.

3. The system of claim 1, further comprising an annular stopper disposed between the sleeve inner diameter surface and the pull tube outer diameter surface and configured to retain the fill material in position between the sleeve and the pull tube until the fill material is hardened.

4. The system of claim 1, further comprising an inlet in the first sleeve configured to allow the fill material to flow into the space between the sleeve and the pull tube.

5. The system of claim 1, further comprising a second pull tube stress joint sleeve disposed around a second welded connection distal from the first welded connection and having a second quantity of the fill material between the sleeve and the pull tube at the second welded connection.

6. The system of claim 1, wherein the fill material comprises cement, polymeric material, rubber, or a combination thereof.

7. The system of claim 1, wherein at least one of the welded connections is nearest to the pull tube guide along the pull tube.

8. The system of claim 1, wherein the upper portion is coupled to the offshore platform distal from the pull tube guide.

9. The system of claim 1, wherein one or more of the segments of the pull tube have a different wall thickness along the length of the segment.

10. The system of claim 1, further comprising at least one ring coupled to a sleeve portion to retain the sleeve portion on the pull tube.

11. The system of claim 1, further comprising at least one clamp disposed around a periphery of the pull tube to retain the sleeve portion on the pull tube.

12. The system of claim 1, wherein the pull tube is longer than the pull tube stress joint.

13. A method of supporting a catenary riser coupled to an offshore platform, comprising:

providing a plurality of segments of a pull tube having an outer diameter surface and an inner diameter surface, the inner diameter surface being sized to allow the riser to pass therethrough;

welding at least two of the segments together to establish one or more welded connections with the pull tube extending longitudinally on both sides of the welded connection;

coupling the pull tube to the offshore platform between a lower end of the pull tube disposed downward from the offshore platform and at an upper portion of the pull tube distal from the lower end disposed toward the offshore platform;

coupling a first pull tube stress joint sleeve around a first welded connection of the pull tube, the first sleeve having an outer diameter surface and an inner diameter surface, the sleeve inner diameter surface being larger than the pull tube outer diameter surface to form an annular gap between the two surfaces, the pull tube stress joint sleeve comprising a plurality of sleeve portions configured to be sealingly coupled together along a longitudinal side of the sleeve portions and further comprising coupling the plurality of sleeve portions together to form the pull tube stress joint sleeve around the pull tube coupling a plurality of stoppers in the annular gap independent of the riser between the sleeve inner diameter surface and the pull tube outer diameter surface; and filling the annular gap between the sleeve inner diameter surface and the pull tube outer diameter surface with a first quantity of a fill material.

14. The method of claim 13, further comprising forming one or more gripping surfaces on the first sleeve, the pull tube at the first welded connection, or a combination thereof to provide displacement resistance to the fill material.

15. The method of claim 13, further comprising blocking an annular space between the first sleeve inner diameter surface and the pull tube outer diameter surface;

retaining the fill material in position between the sleeve and the pull tube; and allowing the fill material to hardened while retaining the fill material.

16. The method of claim 13, wherein filling the gap between the sleeve inner diameter surface and the pull tube outer diameter surface further comprises injecting flowable fill material through an inlet port in the first sleeve.

17. The method of claim 13, further comprising coupling a second pull tube stress joint sleeve around a second welded connection of the pull tube, the second sleeve having an outer diameter surface and an inner diameter surface, the sleeve inner diameter surface being larger than the pull tube outer diameter surface;

filling a gap between the sleeve inner diameter surface of the second sleeve and the pull tube outer diameter surface with a second quantity of fill material.

18. The method of claim 13, wherein coupling the pull tube to the offshore platform comprises coupling the pull tube to a pull tube guide that is coupled to the offshore platform.

19. The method of claim 18, further comprising coupling the upper portion of the pull tube to the offshore platform distal from the pull tube guide.

20. The method of claim 13, wherein the pull tube is longer than the pull tube stress joint.

* * * * *